US006142135A

United States Patent [19]

Thompson

[11] Patent Number: 6,142,135

[45] Date of Patent: Nov. 7, 2000

[54] AIR POWERED GUN SYSTEM

[76] Inventor: Eugene R. Thompson, 2703 - - 50th Ave., Lone Rock, Iowa 50559

[21] Appl. No.: 09/219,261

[22] Filed: Dec. 22, 1998

[51] Int. Cl.[7] ..... F41B 11/32; F41B 11/26

[52] U.S. Cl. ..... 124/70; 124/76

[58] Field of Search ..... 124/70, 73, 76

[56] References Cited

U.S. PATENT DOCUMENTS

| | | | |
|---|---|---|---|
| 558,841 | 4/1896 | Raymond | 124/70 X |
| 3,548,802 | 12/1970 | Green | 124/70 |
| 4,159,705 | 7/1979 | Jacoby | 124/70 X |
| 5,878,735 | 3/1999 | Johnson | 124/70 X |

*Primary Examiner*—Robert P. Swiatek

[57] ABSTRACT

An air powered gun system for allowing a user to fire large projectiles at extremely high velocities by utilizing a conventional air pump. The inventive device includes a stock, a barrel attached to the stock, an air valve connected to the rear end of the barrel, an air chamber connected to the air valve opposite of the barrel, a conventional valve stem attached to the air chamber a trigger lever connected to the air valve, a spring connected to the trigger lever, and a loading shaft for loading a standard projectile or a lighted projectile. A pressure gauge may also be attached to the air chamber to show the pressure within the air chamber. The user inserts the standard projectile or the lighted projectile into the rear portion of the barrel by utilizing the loading shaft. A conventional air pump is removably connectable with the valve stem of the air chamber for inputting pressurized air into the air chamber. The air chamber is designed to receive air pressures that a conventional air pump is capable of inputting. The user removes the conventional air pump after the desired amount of air pressure is inputted and the user then manipulates the trigger lever to release the air pressure within the air chamber into the barrel thereby projecting the standard projectile or lighted projectile.

17 Claims, 3 Drawing Sheets

AIR POWERED GUN SYSTEM

BACKGROUND OF THE INVENTION

1. Field of the Invention

The present invention relates generally to gun devices and more specifically it relates to an air powered gun system for allowing a user to fire large projectiles at extremely high velocities by utilizing a conventional air pump.

2. Description of the Prior Art

Air gun devices have been in use for years. The most common air gun device utilized is commonly called the BB gun. These air guns typically have the air pump built within the gun stock and provide pressurized air for shooting a small projectile such as a BB or a pellet. Another version of common air gun devices utilize air cartridges that are removably inserted into the air gun device thereby providing pressurized air for shooing a small projectile such as a BB or a pellet.

The main problem with conventional air gun devices is that they are incapable of shooting large projectiles such as a wooden dowel or lighted projectiles. A problem with air gun devices with the air pump built within is that they are extremely bulky and cumbersome to handle because of the extra mechanical components required to operate the air pump. An obvious problem with air gun devices that utilize air cartridges is that when all of the air cartridges are exhausted the user is unable to utilize the air gun. The present invention solves all of these problems and provides additional benefits not known or disclosed in the prior art.

Examples of air gun devices include U.S. Pat. No. 627,320 to Benjamin; U.S. Pat. No. 2,273,678 to Webby; U.S. Pat. No. 5,373,832 to D'Andrade; U.S. Pat. No. 4,223,472 to Fekete et al; U.S. Pat. No. 4,159,705 to Jacoby; U.S. Pat. No. 3,739,764 to Allport; U.S. Pat. No. 2,814,041 to Haley which are all illustrative of such prior art.

Benjamin (U.S. Pat. No. 627,320) discloses an air rifle with the air pump permanently attached to the lower portion of the air rifle making it bulky and cumbersome to operate.

Webby (U.S. Pat. No. 2,273,678) discloses a repeating air gun with the air pump built into the rear portion of the stock with a spring-loaded shaft extending outwardly. This invention is another example of an extremely bulky and cumbersome invention.

D'Andrade (U.S. Pat. No. 5,373,832) discloses a multi-shot soft projectile pressurized toy gun having a main housing, a handle, a trigger, and an inflatable bladder.

Fekete et al (U.S. Pat. No. 4,223,472) discloses a toy projectile launching devices having a main tubular member in connection with an air pump, an air storage tank and a projectile launching housing rotatably coupled to the main tubular member.

While these devices may be suitable for the particular purpose to which they address, they are not as suitable for allowing a user to fire large projectiles at extremely high velocities by utilizing a conventional air pump. Conventional air gun devices are incapable of firing a relatively large projectile because of the relatively low pressures they are capable of accumulating.

In these respects, the air powered gun system according to the present invention substantially departs from the conventional concepts and designs of the prior art, and in so doing provides an apparatus primarily developed for the purpose of allowing a user to fire large projectiles at extremely high velocities by utilizing a conventional air pump.

SUMMARY OF THE INVENTION

In view of the foregoing disadvantages inherent in the known types of air gun devices now present in the prior art, the present invention provides a new air powered gun system construction wherein the same can be utilized for allowing a user to fire large projectiles at extremely high velocities by utilizing a conventional air pump.

The general purpose of the present invention, which will be described subsequently in greater detail, is to provide a new air powered gun system that has many of the advantages of the air gun devices mentioned heretofore and many novel features that result in a new air powered gun system which is not anticipated, rendered obvious, suggested, or even implied by any of the prior art air gun devices, either alone or in any combination thereof.

To attain this, the present invention generally comprises a stock, a barrel attached to the stock, an air valve connected to the rear end of the barrel, an air chamber connected to the air valve opposite of the barrel, a conventional valve stem attached to the air chamber a trigger lever connected to the air valve, a spring connected to the trigger lever, and a loading shaft for loading a standard projectile or a lighted projectile. A pressure gauge may also be attached to the air chamber to show the pressure within the air chamber. The user inserts the standard projectile or the lighted projectile into the rear portion of the barrel by utilizing the loading shaft. A conventional air pump is removably connectable with the valve stem of the air chamber for inputting pressurized air into the air chamber. The air chamber is designed to receive air pressures that a conventional air pump is capable of inputting. The user removes the conventional air pump after the desired amount of air pressure is inputted and the user then manipulates the trigger lever to release the air pressure within the air chamber into the barrel thereby projecting the standard projectile or lighted projectile.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an air powered gun system that will overcome the shortcomings of the prior art devices.

Another object is to provide an air powered gun system that is capable of firing relatively large projectiles significant distances.

An additional object is to provide an air powered gun system that is lightweight and easy to operate.

A further object is to provide an air powered gun system that can be utilized many times without having to reload a pressure cartridge.

Another object is to provide an air powered gun system that is simple in construction.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
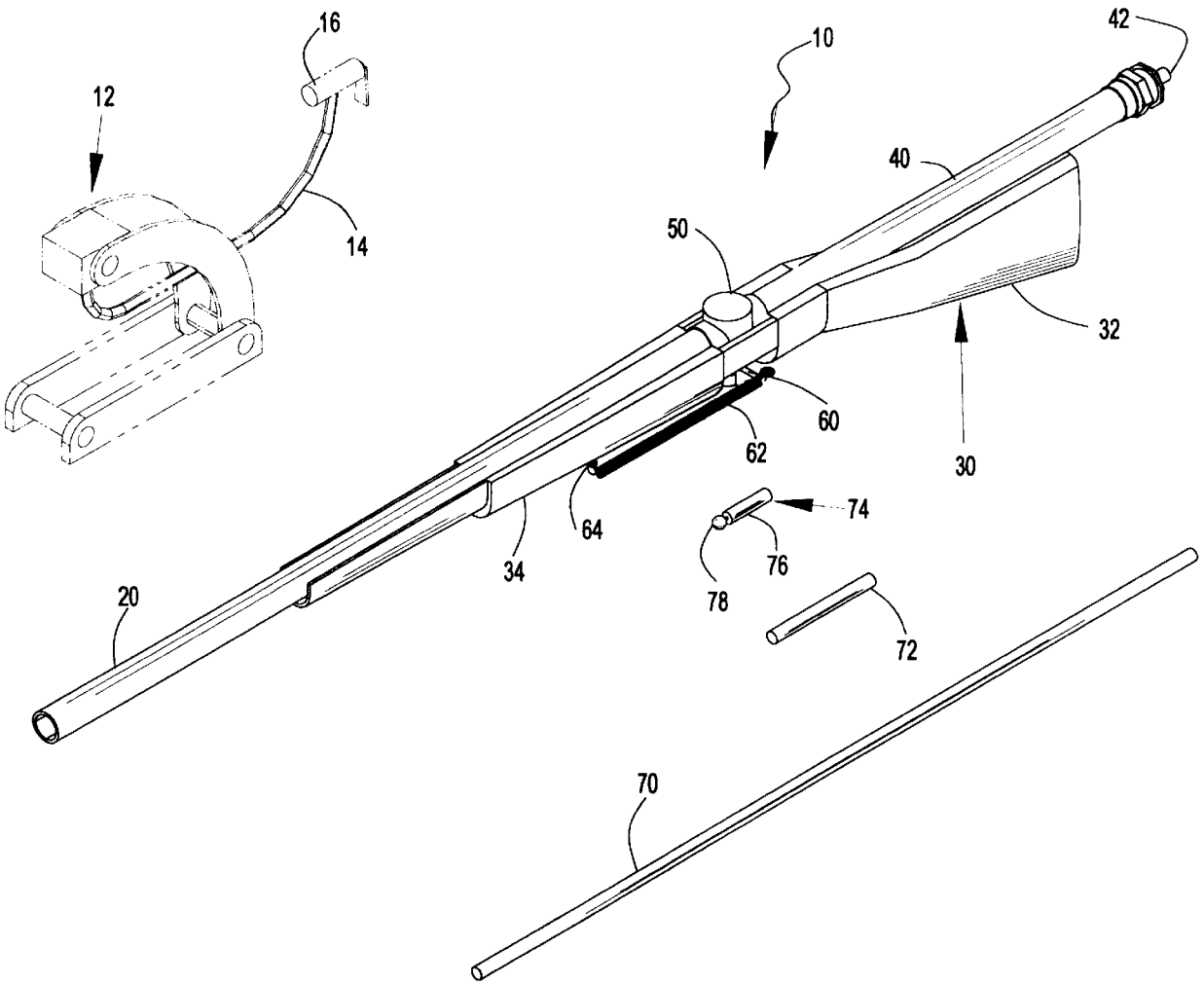
FIG. 1 is an upper perspective view of the present invention along with a conventional air pump.

Turning now descriptively to the drawings, in which similar reference characters denote similar elements throughout the several view, FIGS. 1 through 4 illustrate an air powered gun system 10, which comprises a stock 30, a barrel 20 attached to the stock 30, an air valve 50 connected to the rear end of the barrel 20, an air chamber 40 connected to the air valve 50 opposite of the barrel 20, a conventional valve stem 42 attached to the air chamber 40 a trigger lever 60 connected to the air valve 50, a spring 62 connected to the trigger lever 60, and a loading shaft 70 for loading a standard projectile 72 or a lighted projectile 74. A pressure gauge may also be attached to the air chamber 40 to show the pressure within the air chamber 40.

Figure 2:
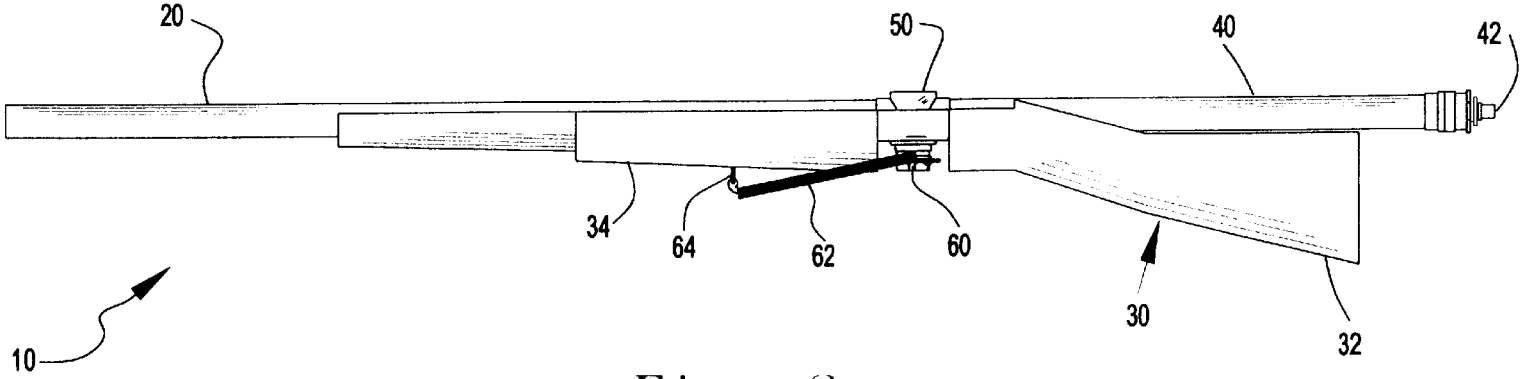
FIG. 2 is a side view of the present invention.
Figure 3:
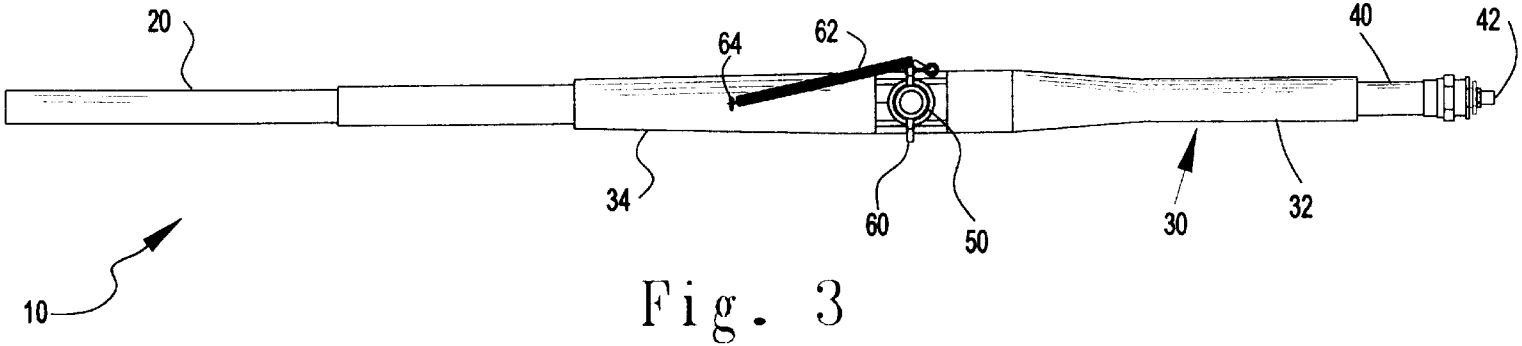
FIG. 3 is a bottom view of the present invention.

As best shown in FIGS. 1 through 3 of the drawings, the stock 30 has a shoulder rest 32 and a front portion. The stock 30 has a conventional stock shape for rifles. It can be appreciated by one skilled in the art that the present invention can also have a pistol shaped embodiment by simply shortening the barrel 20 and the stock 30. The stock 30 preferably is constructed of wood, however any other material may be utilized.

As shown in FIGS. 1 through 3, the barrel 20 is of an elongated cylindrical shape and is attached to the front portion of the stock 30. The barrel 20 has a front end and a rear end, wherein the projectile 72, 74 is inserted into the front end of the barrel 20. The barrel 20 has a bore that is of a sufficient diameter to receive a relatively large diameter objects. The barrel 20 is preferably constructed of a plastic material, however various other materials may be utilized.

Figure 4:
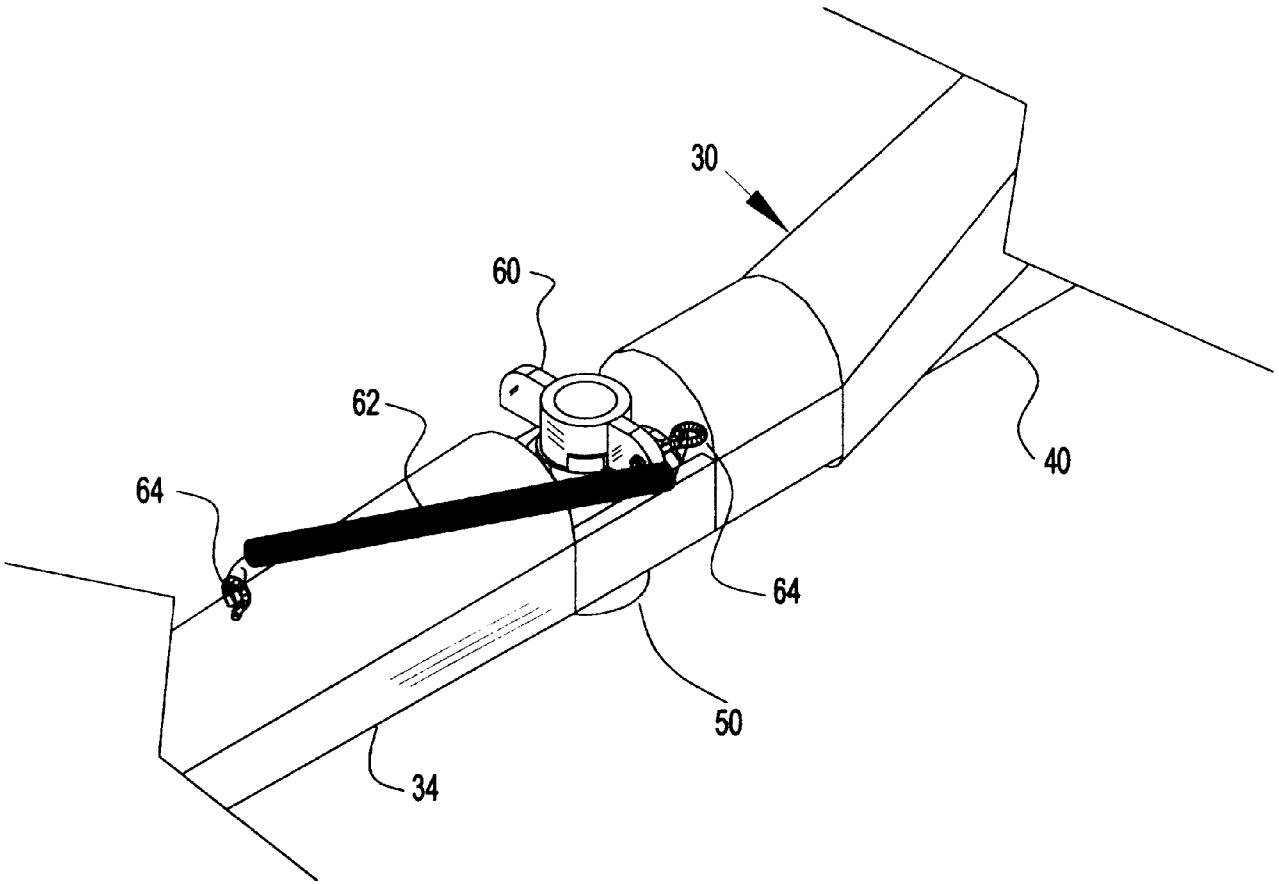
FIG. 4 is a lower perspective view of the present invention disclosing the air valve in the closed position.

As shown in FIGS. 1 through 4, the air valve 50 is connected to the rear end of the barrel 20. A trigger lever 60 is mechanically connected to the lower portion of the air valve 50 to allow manual closing and opening of the air valve 50 by the user. The trigger lever 60 can obviously have various designs to accommodate the user's fingers. As shown in FIGS. 3 and 4 of the drawings, the trigger lever 60 has a wing shape design to allowing manipulation by the user.

As shown in FIGS. 1 through 4, a spring 62 is connected to an end of the trigger lever 60 and to an eyelet 64 within the stock 30. The spring 62 assists the user in manipulating the trigger lever 60 connected to the air valve 50 so as to open the air valve 50 easier. In addition as shown in FIG. 4 of the drawings, another eyelet 64 is preferably connected to the trigger lever 60 to provide additional leverage by the spring 62 during the final phase of opening the air valve 50.

As shown in FIGS. 1 through 3, the air chamber 40 is fluidly connected to the air valve 50 opposite of the barrel 20. The air chamber 40 is preferably of a narrow elongated shape, however it can be appreciated that various shapes and designs may be utilized for the air chamber 40. The valve stem 42 is preferably attached to a rear portion of the air chamber 40 as shown in FIGS. 2 and 3 of the drawings. The valve stem 42 is matable with a nozzle 16 of a conventional air pump 12 as utilized in conventional vehicle tires.

As shown in FIG. 1 of the drawings, the loading shaft 70 is elongated and has an outer diameter less than the diameter of the bore within the barrel 20. The loading shaft 70 is longer than the barrel 20 as shown in FIG. 1 of the drawings to allow complete insertion of the projectile 72, 74 into the barrel 20.

As further shown in FIG. 1, a standard projectile 72 may be utilized which has a generally cylindrical shape such as a wooden dowel. A lighted projectile 74 may also be utilized to increase the visual effects during nighttime usage. The lighted projectile 74 comprises a battery source 76 and a light bulb 78 attached to an end of the battery source 76. The light bulb 78 is electrically connected to the battery source 76 to allow illumination of the light bulb 78. A switch or a permanent connector can be utilized to selectively illuminate the light bulb 78 thereby retaining the charge within the battery source 76.

In use, the user inserts the standard projectile 72 or the lighted projectile 74 into the rear portion of the barrel 20 by utilizing the loading shaft 70. The user makes sure that the air valve 50 is in the closed position to prevent air from escaping from the air chamber 40 into the barrel 20. Once the projectile 72, 74 is positioned in the rear end of the barrel 20, a nozzle 16 of a conventional air pump 12 is connected with the valve stem 42 of the air chamber 40 for inputting pressurized air into the air chamber 40. The hose 14 of the conventional air pump 12 may be manipulated by the user as they may need to. The user manipulates the conventional air pump 12 to insert air into the air chamber 40 thereby creating an air pressure within the air chamber 40. The air chamber 40 is designed to receive air pressures that a conventional air pump 12 is capable of inputting. The user removes the conventional air pump 12 after the desired amount of air pressure is inputted. The user then locates a target to shoot at and aims the invention as with a conventional rifle or pistol. The user then manipulates the trigger lever 60 to open the air valve 50 thereby releasing the pressurized air within the air chamber 40 into the rear end of the barrel 20 thereby projecting the standard projectile 72 or lighted projectile 74 from the barrel 20 at an extremely high velocity. The above procedure is repeated to fire the invention again.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air powered gun system, comprising:

a gun stock;

a barrel attached to said gun stock, wherein said barrel has a front end and a rear end;

a valve fluidly connected to said rear end of said barrel;

an air chamber having an inlet means for receiving pressurized air from a conventional air pump, wherein said air chamber is fluidly connected to said valve opposite of said barrel;

a trigger lever connected to said valve for allowing manual manipulation by a user;

a spring attached between said stock and an end of said trigger lever for assisting said user in manipulating said valve into an open position; and an eyelet connected to said trigger lever and wherein said eyelet receives said spring, whereby said eyelet provides increased leverage during opening of said valve.

2. The air powered gun system of claim 1, wherein said stock has a shoulder rest and a front portion.

3. The air powered gun system of claim 1, wherein said inlet means is a conventional valve stem for receiving a conventional nozzle from said conventional air pump.

4. The air powered gun system of claim 1, wherein said barrel has a bore larger in diameter than 0.25 inches.

5. The air powered gun system of claim 1, wherein said barrel is comprised of plastic material.

6. The air powered gun system of claim 1, wherein said stock is comprised of wood material.

7. An air powered gun system, comprising:

a gun stock;

a barrel attached to said gun stock, wherein said barrel has a front end and a rear end;

a valve fluidly connected to said rear end of said barrel;

a loading shaft for inserting a projectile into said barrel near said rear end;

an air chamber having an inlet means for receiving pressurized air from a conventional air pump, wherein said air chamber is fluidly connected to said valve opposite of said barrel;

a trigger lever connected to said valve for allowing manual manipulation by a user;

a spring attached between said stock and an end of said trigger lever for assisting said user in manipulating said valve into an open position; and an eyelet connected to said trigger lever and wherein said eyelet receives said spring, whereby said eyelet provides increased leverage during opening of said valve.

8. The air powered gun system of claim 7, wherein said stock has a shoulder rest and a front portion.

9. The air powered gun system of claim 7, wherein said inlet means is a conventional valve stem for receiving a conventional nozzle from said conventional air pump.

10. The air powered gun system of claim 7, wherein said projectile is comprised of:

a battery source having a cylindrical shape; and a light bulb electrically connectable to said battery source.

11. The air powered gun system of claim 10, wherein said projectile further includes a switch connected between said battery source and said light bulb.

12. An air powered gun system, comprising:

a stock;

a tube attached to said stock, wherein said tube has a front end and a rear end;

a valve fluidly connected to said rear end of said tube;

an air chamber having an inlet for receiving pressurized air from an air pump, wherein said air chamber is fluidly connected to said valve opposite of said tube;

a trigger lever connected to said valve for allowing manual manipulation by a user;

a spring attached between said stock and an end of said trigger lever for assisting said user in manipulating said valve into an open position; and an eyelet connected to said trigger lever and wherein said eyelet receives said spring, whereby said eyelet provides increased leverage during opening of said valve.

13. The air powered gun system of claim 12, wherein said stock has a shoulder rest and a front portion.

14. The air powered gun system of claim 12, wherein said inlet is a valve stem for receiving a conventional nozzle from said conventional air pump.

15. The air powered gun system of claim 12, wherein said tube has a bore larger in diameter than 0.25 inches.

16. The air powered gun system of claim 12, wherein said barrel is comprised of plastic material.

17. The air powered gun system of claim 12, wherein said stock is comprised of wood material.

* * * * *